US010224015B2

(12) United States Patent
Hsu

(10) Patent No.: US 10,224,015 B2
(45) Date of Patent: Mar. 5, 2019

(54) STRINGLESS BOWED MUSICAL INSTRUMENT

(71) Applicant: Jeffrey James Hsu, Broomfield, CO (US)

(72) Inventor: Jeffrey James Hsu, Broomfield, CO (US)

( * ) Notice: Subject to any disclaimer, the term of this patent is extended or adjusted under 35 U.S.C. 154(b) by 0 days.

(21) Appl. No.: 15/289,081

(22) Filed: Oct. 7, 2016

(65) Prior Publication Data

US 2017/0103741 A1 Apr. 13, 2017

Related U.S. Application Data

(60) Provisional application No. 62/239,819, filed on Oct. 9, 2015.

(51) Int. Cl.
*G10H 1/34* (2006.01)
*G10H 1/00* (2006.01)
(Continued)

(52) U.S. Cl.
CPC ..... *G10H 1/342* (2013.01); *G10H 1/0016* (2013.01); *G10H 3/125* (2013.01); *G10H 3/143* (2013.01);
(Continued)

(58) Field of Classification Search
CPC ..... G10H 1/342; G10H 3/125; G10H 3/143; G10H 2220/021
(Continued)

(56) References Cited

U.S. PATENT DOCUMENTS 88,423 A 3/1869 Upson
322,270 A 7/1885 Engel
(Continued)

FOREIGN PATENT DOCUMENTS

CN 2482170 Y 3/2002
CN 2522954 Y 11/2002
(Continued)

OTHER PUBLICATIONS

Hsu U.S. Office Action dated May 17, 2016, directed to U.S. Appl. No. 14/534,362; 8 pages.
(Continued)

*Primary Examiner* — David Warren
(74) *Attorney, Agent, or Firm* — Morrison & Foerster LLP

(57) ABSTRACT

A stringless electric bowed musical instrument is disclosed in which sensors are provided to detect finger positions and bowing motions of the player. A touch-sensitive fingerboard surface is equipped with pitch sensors that detect finger positions. Use of a fingerboard surface that includes an interactive flexible touch screen display provides a plurality of illumination patterns to be displayed on the fingerboard and permits various operational modes that are useful for both students and artists. A bowing platform in contact with either the fingerboard or the body of the instrument provides an adjustable bowing surface for including bow sensors configured to detect vibrations in response to bow motion. The bow sensors may include piezo-ceramic elements. Optical pitch sensors may sense interruption of one or more laser beams that propagate above a top surface of the fingerboard.

18 Claims, 14 Drawing Sheets

(51) Int. Cl.
*G10H 3/12* (2006.01)
*G10H 3/14* (2006.01)

(52) U.S. Cl.
CPC . *G10H 2220/021* (2013.01); *G10H 2220/096* (2013.01); *G10H 2220/241* (2013.01); *G10H 2220/311* (2013.01); *G10H 2220/365* (2013.01); *G10H 2220/411* (2013.01); *G10H 2230/075* (2013.01)

(58) Field of Classification Search
USPC ..... 84/724
See application file for complete search history.

(56) References Cited

U.S. PATENT DOCUMENTS 766,549 A 8/1904 Strauss et al.
1,275,202 A 8/1918 Becker
1,603,371 A * 10/1926 Zahn ..... G10D 3/166 84/283
1,694,786 A 12/1928 Larsen
1,753,053 A 4/1930 Braunstein-Loskant
2,239,579 A 4/1941 Solodar
3,051,034 A 8/1962 Kozak
3,730,964 A 5/1973 Kaplan
4,177,705 A * 12/1979 Evangelista ..... G10H 1/342 84/720
4,311,078 A * 1/1982 Falgares ..... G10D 3/06 84/267
RE31,019 E * 8/1982 Evangelista ..... G10H 1/342 84/702
4,630,520 A 12/1986 Bonanno
4,632,002 A * 12/1986 Clevinger ..... G10H 3/185 84/291
4,776,323 A 10/1988 Spector
4,805,510 A * 2/1989 De Dianous ..... G10H 1/0556 84/282
4,854,212 A 8/1989 Levin et al.
4,882,965 A * 11/1989 McClish ..... G10H 3/186 84/453
4,884,486 A * 12/1989 McClish ..... G01H 1/14 84/736
4,915,009 A * 4/1990 Kunstadt ..... G10H 3/18 84/291
4,919,033 A * 4/1990 Markov ..... G10H 3/18 84/726
4,986,792 A 1/1991 Chen
5,038,662 A * 8/1991 Ho ..... G09B 15/04 84/453
D322,270 S 12/1991 Concoff
5,085,119 A 2/1992 Cole
5,117,730 A * 6/1992 Yamauchi ..... G10H 1/055 84/723
5,239,123 A * 8/1993 Fujita ..... G10H 7/06 84/453
5,286,911 A * 2/1994 Murata ..... G10D 3/16 84/615
5,396,025 A * 3/1995 Tamura ..... G10H 1/12 84/736
5,401,898 A * 3/1995 Usa ..... G10H 1/0558 84/658
5,488,196 A * 1/1996 Zimmerman ..... G10H 1/0033 84/612
5,661,253 A * 8/1997 Aoki ..... G05G 9/047 84/658
5,670,727 A 9/1997 Xiao
5,739,455 A 4/1998 Poon
5,977,462 A * 11/1999 Wolfson ..... G10D 3/06 84/267
6,162,981 A * 12/2000 Newcomer ..... G09B 15/04 84/470 R
6,288,320 B1 * 9/2001 Murakami ..... G10H 1/342 84/600
6,479,741 B1 * 11/2002 Morton ..... G10H 1/26 446/408
6,777,600 B2 8/2004 Daring
7,521,619 B2 4/2009 Salter
7,777,117 B2 8/2010 Salter
8,093,486 B2 1/2012 Behringer et al.
8,141,703 B2 * 3/2012 Sonoda ..... G10G 7/005 206/14
8,471,138 B2 6/2013 Wallace et al.
8,492,641 B2 7/2013 Menzies-Gow
8,796,529 B2 8/2014 Butera et al.
8,975,501 B2 3/2015 Roebke
9,082,380 B1 7/2015 Hamilton et al.
9,224,376 B1 12/2015 Feng
9,767,706 B2 * 9/2017 Hsu ..... G09B 15/06
2002/0005108 A1 * 1/2002 Ludwig ..... G10H 1/00 84/600
2002/0184989 A1 * 12/2002 Meisel ..... G10C 3/12 84/216
2004/0007116 A1 * 1/2004 Marcus ..... G10C 3/00 84/10
2004/0237751 A1 * 12/2004 Foxwell ..... G10D 3/166 84/283
2005/0120870 A1 * 6/2005 Ludwig ..... G10H 1/00 84/661
2006/0011049 A1 1/2006 Takabayashi
2006/0213358 A1 * 9/2006 Motsenbocker ..... G10H 3/185 84/731
2007/0121095 A1 5/2007 Lewis
2008/0236374 A1 10/2008 Kramer et al.
2008/0271594 A1 * 11/2008 Starr ..... G10H 1/342 84/646
2008/0307949 A1 12/2008 Lee
2009/0071314 A1 3/2009 Huwaldt
2009/0100992 A1 4/2009 Elion
2009/0216483 A1 * 8/2009 Young ..... G10H 1/46 702/138
2009/0308232 A1 * 12/2009 McMillen ..... G10D 3/16 84/723
2011/0004328 A1 1/2011 Darcey et al.
2011/0132180 A1 6/2011 Gobbers
2011/0146476 A1 6/2011 Zimmerman
2011/0283868 A1 * 11/2011 Behringer ..... G10H 1/0008 84/622
2012/0090446 A1 4/2012 Moreno
2012/0210846 A1 8/2012 Sullivan
2012/0240751 A1 * 9/2012 Yonetani ..... G10H 3/18 84/726
2012/0272814 A1 * 11/2012 Menzies-Gow ..... G10H 1/0553 84/724
2012/0297953 A1 * 11/2012 Pukalo ..... G10D 1/00 84/291
2013/0174717 A1 * 7/2013 Butera ..... G10H 1/32 84/609
2013/0284001 A1 10/2013 Menzies-Gow
2014/0083279 A1 3/2014 Little et al.
2014/0083280 A1 3/2014 Little et al.
2014/0149911 A1 5/2014 Lam
2015/0053065 A1 2/2015 Van Wagoner et al.
2015/0122109 A1 * 5/2015 Hsu ..... G09B 15/06 84/465
2015/0206521 A1 * 7/2015 Sexton ..... G10H 3/146 84/609
2015/0269852 A1 9/2015 Cecil et al.
2015/0279343 A1 10/2015 Shi
2016/0163298 A1 * 6/2016 Butera ..... G10H 1/342 84/615
2017/0103741 A1 * 4/2017 Hsu ..... G10H 1/342
2017/0323624 A1 * 11/2017 Parker ..... G10H 1/14

FOREIGN PATENT DOCUMENTS

CN 2655379 Y 11/2004
FR 2502823 A1 10/1982
WO WO-91/05328 A1 4/1991

(56) References Cited

FOREIGN PATENT DOCUMENTS

| | | | |
|---|---|---|---|
| WO | WO-97/43752 | A2 | 11/1997 |
| WO | WO-2008/017233 | A1 | 2/2008 |

OTHER PUBLICATIONS

Hsu U.S. Office Action dated Jan. 26, 2017, directed to U.S. Appl. No. 14/534,362; 9 pages.
Anonymous (2010). "Misa Digital Guitar" 1 page, Retrieved Oct. 5, 2016 from <https://www.youtube.com/watch?v=M2eiP12hQQY>.
Anonymous (2011). "Laser Guitar," 1 page, Retrieved Oct. 5, 2016 from <https://www.youtube.com/watch?v=4CnRsTaShUU>.
Anonymous (2015). "The Sensel Morph: Interaction, Evolved," 14 pages, Retrieved Oct. 5, 2016 from <https://www.kickstarter.com/projects/1152958674/the-sensel-morph-interaction-evolved>.
Anonymous, "Haken Audio, Continuum Fingerboard," 1 page, Retrieved Oct. 5, 2016 from <http://www.hakenaudio.com/Continuum/hakenaudioovervg.html>.
Anonymous, "Introducing the Artiphon Instrument 1, Strum a guitar, bow a violin, tap a piano, loop a beat—on a single instrument. An intuitive way to create music and play any sound," 6 pages, Retrieved Oct. 6, 2016 from <http://artiphon.com/>.
Anonymous, "Laser harp," Wikipedia, 4 pages, Retrieved Oct. 6, 2016 from <https://en.wikipedia.org/w/index.php?title=Laser_harp&oldid=716360999.
Anonymous, "Linnstrument," 1 page, Retrieved Oct. 5, 2016 from <https://www.rogerlinndesign.com/>.
Anonymous, "Otamatone Digital from Maywa Denki—New Generation Otamatone Keyboard Style (Black)," 2 pages, Retrieved Oct. 5, 2016 from <https://www.amazon.com/Otamatone-Touch-Sensitive-Electronic-Musical-Instrument/dp/B00NARJ8LSU>.
Anonymous, "Seaboard RISE," 2 pages, Retrieved Oct. 5, 2016 from <https://roli.com/>.
Griffiths, "A digital one-man band: Instrument can be played as a keyboard, guitar and a drum kit," The Daily Mail, published on Mar. 4, 2015, 5 pages.
Ravilious, "Gene for Left-Handed Trait Discovered," National Geographic News, Aug. 1, 2007, retrieved from http://news.nationalgeographic.com/news/pf/13282887.html, retrieved on Nov. 4, 2014, 2 pages.
Samuel, "Stringless Violin to Bring Feeling to Computer Music," New Scientist, May 16, 2002, retrieved from http://www.newscientist.com/article/ dn2282-stringless-violin-to-bring-feeling-to-computer . . . , retrieved on Nov. 4, 2014, 2 pages.
Sears (2005). "Vibrato—Touch Sensitive Musical Instrument," 1 page, Retrieved Oct. 5, 2016 from <http://www.jamesnsears.com/2005/12/vibrato_touch_sensitive_musica.php>.
Tilley et al., The Measure of Man and Woman: Human Factors in Design, John Wiley & Sons, New York, 2002, pp. 7 4-7 5.

* cited by examiner

STRINGLESS BOWED MUSICAL INSTRUMENT

CROSS-REFERENCE TO RELATED APPLICATIONS

This patent application claims priority from U.S. Provisional Patent Application Ser. No. 62/239,819, entitled "Stringless Bowed Musical Instrument," filed on Oct. 9, 2015, which is hereby incorporated by reference in its entirety for all purposes.

FIELD

The present disclosure relates generally to bowed musical instruments and, in particular, to stringless implementations of bowed musical instruments of the violin family.

BACKGROUND

Electric bowed musical instruments, e.g., stringed instruments of the violin family (violin, viola, cello, bass), have been available for decades, since at least the 1970s. Electric instruments differ from amplified acoustic instruments in that they produce only a faint sound when they are not powered. In a conventional electric guitar or violin, for example, sound is generated electronically by sensing string vibration, as opposed to setting up an acoustic standing wave within the body of the instrument. Consequently, such electric stringed musical instruments need not provide a box for amplifying acoustic waves. Therefore, many form factors are possible—electric stringed musical instruments can have a solid body, a partial body, or a very minimal body—just a fingerboard and strings. Electric stringed instruments allow the performing artist to create many different sound colors that are not possible using a traditional acoustic instrument, or an amplified acoustic instrument. However, existing electric guitars and violins are still equipped with strings, and it is the string vibration that is sensed to produce amplified sound.

Numerous designs for stringless guitars have been proposed. However, some stringless guitars are more like electronic toys than musical instruments because they do not create sound by sensing and shaping a physical vibration. A stringless bowed musical instrument was disclosed by the present inventor in U.S. patent application Ser. No. 14/534,162, which is incorporated by reference herein in its entirety. In place of strings, the stringless bowed musical instrument features a vibrational bowing platform equipped with bow sensors, and pressure-sensitive or optical pitch sensors that sense finger placement along a fingerboard. Various embodiments of the bowing platform include a uni-track platform and a multi-track platform, either of which can be attached to the body of the instrument, or to the end of the fingerboard.

BRIEF SUMMARY

An advanced stringless bowed musical instrument features a fingerboard that senses finger placement using touch screen technology. In addition, the touch screen fingerboard provides a programmable user interface for selecting additional functions and operational modes of the instrument. The touchscreen fingerboard can toggle between a control panel mode, a display mode, an exercise mode, and a playing mode, for example. In the control panel mode, the action, or sensitivity, of the touch-sensitive fingerboard can be adjusted. In the display mode, a visual playback of stored note patterns can be displayed on the touchscreen display for viewing by the player or an instructor. In the playing mode, music or fingering patterns stored in a digital library can be compared with real-time notes being played, and the player can receive vibrational feedback when left hand finger placement is incorrect, instead of, or in addition to, aural feedback. As the player gains control of a particular technique, the player can advance to a higher grade level, select a more difficult exercise, or enter a performance mode.

Additionally or alternatively, optical pitch sensors may be used to sense finger placement. For example, a selectable number of laser beams having sources and detectors mounted in the body of the instrument or in the bowing platform may provide virtual strings that sense pitch according to finger locations. A beam splitter may be used to create multiple virtual strings from a single laser beam.

An adjustable bowing platform senses bow contact angle, speed, pressure, and placement. The adjustable bowing platform may be expandable and retractable to provide a single track or a multi-track bowing surface. Adjustments to the bowing platform may include different angular positions. When the adjustable bowing platform is mounted to the top of the instrument, a support may be equipped with a waveguide for guiding a laser beam path between the body and the fingerboard.

A control system integrated with the advanced stringless bowed musical instrument is programmed with user tools to assist students, teachers, artists, and non-artists in their use of the stringless instrument. The control system may communicate with a mobile device that is removeably coupled to the instrument.

The advanced stringless bowed musical instrument can be advantageous to students because it provides learning aids and exercises that are not possible on a traditional instrument. With the use of sensors, e.g., piezo-ceramic sensors, for both the left and right hand motions and one or more sound generating devices, strings are no longer necessary or even desirable. In the absence of strings of different gauges and in the absence of string tension, structural aspects of bowed instruments can be made more symmetric. Both the bowing platform and the open fingerboard serve as learning tools for the student. Being able to switch from a single bowing track to a multi-track bowing surface helps the student isolate and perfect bow control skills. Without string tension and resistance, movement along the fingerboard is unimpeded and therefore beginners can make faster pitch adjustments and play fewer out-of-tune notes. Illuminating finger positions on a fingerboard that is also a display provides much more guidance than chart tapes applied to the fingerboard of a traditional stringed instrument. Being able to practice in a silent mode without creating dissonant or otherwise unpleasant "beginner sounds" is advantageous to students and those they live with, by reducing the frustration that so often halts musical progress. In addition, a stringless instrument is perceptually less intimidating for non-artists.

With the use of sensors, e.g., piezo-ceramic sensors, for both the left and right hand motions and one or more sound generating devices, strings are no longer necessary or even desirable. In the absence of strings of different gauges and without string tension, structural aspects of bowed instruments can be made more symmetric, which may be advantageous for instrument builders.

The various bowing platforms and interactive fingerboard embodiments of the advanced stringless bowed instrument also enhance creative opportunities for the performing artist. For example, left hand movement is no longer confined along four conventional string axes, and can therefore move anywhere on the fingerboard. Also, a multi-track bowing platform can be adjusted to be more or less concave, e.g., emulating a baroque style instrument or a classical style instrument, thereby facilitating proper bowing mechanics for different musical styles. Musical nuance that is created at the point of contact between the bow and the track, and at the point of contact between the left hand fingers and the fingerboard is captured accurately by the sensors. Recordings can be made by sensing signals directly from the instrument, independent of room acoustics, background noise, and other impediments.

DESCRIPTION OF THE FIGURES

For a better understanding of the various described embodiments, reference should be made to the Description of Embodiments below, in conjunction with the following drawings in which like reference numerals refer to corresponding parts throughout the figures.

DESCRIPTION OF EMBODIMENTS

The following description sets forth exemplary methods, parameters, and the like. It should be recognized, however, that such description is not intended as a limitation on the scope of the present disclosure but is instead provided as a description of exemplary embodiments.

Although the following description uses terms "first," "second," etc. to describe various elements, these elements should not be limited by the terms. These terms are only used to distinguish one element from another. For example, a first sensor could be termed a second sensor, and, similarly, a second sensor could be termed a first sensor, without departing from the scope of the various described embodiments. The first sensor and the second sensor are both sensor, but they are not the same sensor.

The terminology used in the description of the various described embodiments herein is for the purpose of describing particular embodiments only and is not intended to be limiting. As used in the description of the various described embodiments and the appended claims, the singular forms "a", "an," and "the" are intended to include the plural forms as well, unless the context clearly indicates otherwise. The term "and/or" as used herein refers to and encompasses any and all possible combinations of one or more of the associated listed items. The terms "includes," "including," "comprises," and/or "comprising," when used in this specification, specify the presence of stated features, steps, operations, elements, and/or components, but do not preclude the presence or addition of one or more other features, steps, operations, elements, components, and/or groups thereof.

The term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

Figure 1:
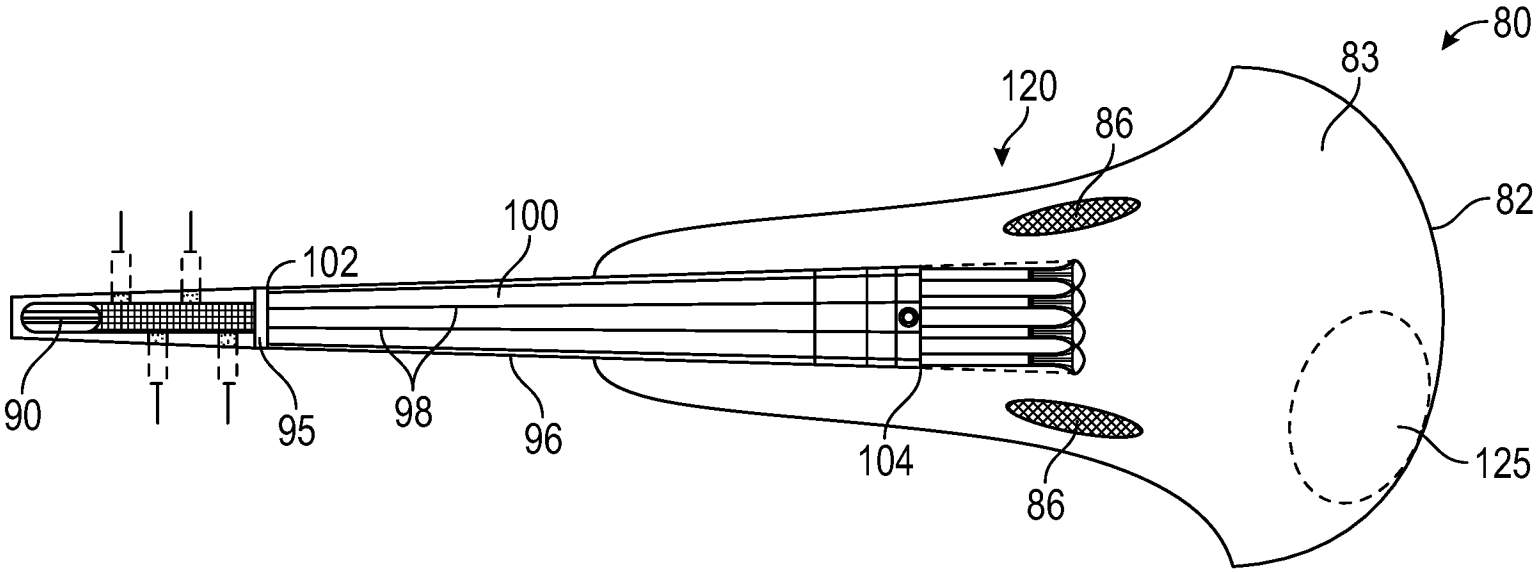
FIG. 1 is a top plan view of an advanced stringless bowed instrument, according to some embodiments of the present disclosure as described herein.

Turning now to the drawings, FIG. 1 illustrates a stringless bowed instrument 80, e.g., a stringless violin, viola, cello, or bass, according to an embodiment of the present disclosure. In one embodiment, the stringless bowed instrument 80 includes the following parts: a body 82, a top 83, optional speakers 86, a scroll 90, a nut 95, a neck 96, virtual strings 98, a fingerboard 100 having a distal end 102 and a proximal end 104, and a vibrational bowing platform 120 for receiving a bow 124. As is commonly known in the art, the body 82 has an arbitrary shape and may be solid, hollow, or partially hollow; electronic components are housed within the body 82; the neck 96 is attached to the body 82; and the fingerboard 100 is attached to the neck 96 and extends over the top 83. A chinrest 125 is an optional accessory attached to the body 82.

The stringless bowed instrument 80 replaces strings with electronic sensors that can be used to create sound in accordance with the player's movements. In particular, the fingerboard 100 is equipped with finger placement sensors, and the vibrational bowing platform 120 is equipped with bow sensors configured to capture information from the player's movements which can then processed electronically to generate sound. The fingerboard 100, the vibrational bowing platform 120, and associated sensors are described in detail herein.

Figure 2A:
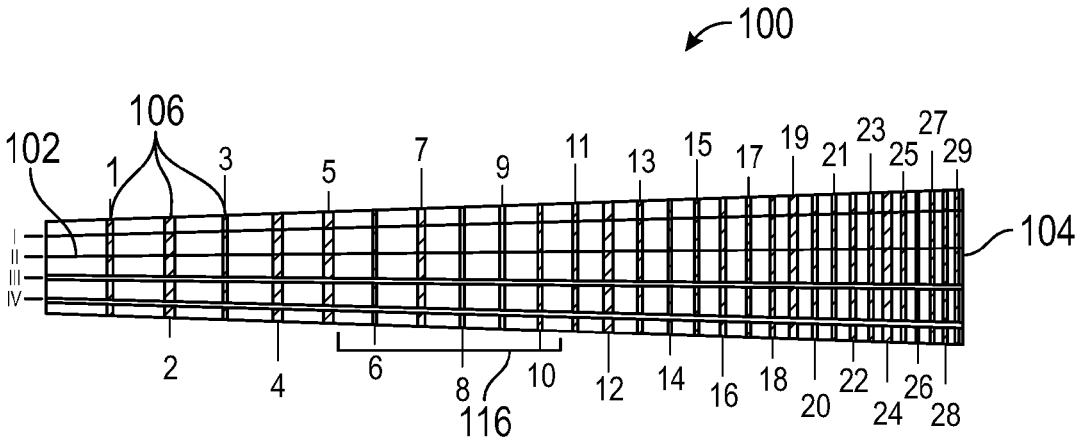
FIGS. 2A, 2B, and 2C are top plan, side elevation, and end views, respectively of an instrument fingerboard on which graphics of virtual strings and virtual fret lines are printed or embossed, according to some embodiments of the present disclosure as described herein.
Figure 2B:
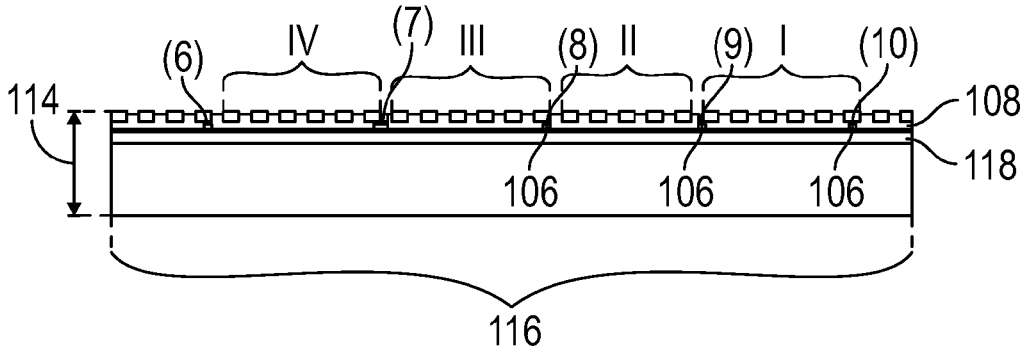
Figure 2C:
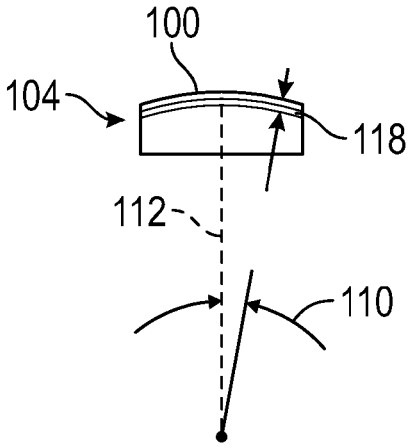

FIGS. 2A-2C show different views of the fingerboard 100, according to some embodiments of the present disclosure. FIG. 2A shows a top plan view of the fingerboard 100 in which the distal end 102 is near the scroll 90 and the proximal end 104 is opposite the scroll 90. The fingerboard 100 includes pitch indicators 106, e.g., fret lines that resemble frets on a guitar, and virtual string indicators: four shown, I, II, III, IV corresponding to strings on a conventional instrument. The numbers and attributes of the pitch indicators 106 and string indicators I-IV may be fixed or variable, depending on the embodiment. While finger positions are sensed as musical pitches along the entire surface of the fingerboard 100, the pitch indicators 106 provide visual information for guiding finger positions. In contrast, a conventional violin has no pitch indicators, e.g., frets, and therefore requires the player to learn the pitch locations by ear. Playing in tune without any visual or tactile pitch indicators is one of the biggest challenges for players of conventional bowed stringed instruments. The pitch indicators 106 are spaced apart from one another so that spaces between adjacent pitch indicators are wider at the distal end 102 and narrower at the proximal end 104, as is typical for stringed instruments. The pitch indicators 106 may have different widths based on user preference, or depending on various note intervals that they represent. For example, pitch indicators 2, 4, 5, and 7 that represent successive notes on a scale are farther apart than pitch indicators 1 and 6 that represent half tones between successive notes.

In some embodiments, graphics for fixed pitch indicators 106 are painted on, attached to, or embossed on the fingerboard 100. The pitch indicators 106 may therefore extend above a top surface of the fingerboard 100, thus providing a textured surface and tactile feedback for the player. In some embodiments, pitch indicators 106 are illuminated as described below. Illuminated pitch indicators 106 do not alter the tactile surface of the fingerboard 100. Illuminated pitch indicators 106 may be programmed to have different attributes, for example, variable widths depending on the key of the music being played, e.g., C major, F minor, D major, and the like, or depending on the mode of the music being played e.g., major, minor, Dorian, Lydian, and the like. Instead of tactile feedback, illuminated pitch indicators 106 may be coupled with a vibrational feedback mechanism.

The string indicators I-IV provide a visual representation of strings that are not present on a stringless instrument. In some embodiments, fixed string indicators I-IV are painted on, attached to, or embossed on the fingerboard 100. The string indicators I-IV may therefore extend above a top surface of the fingerboard 100, thus providing a textured surface and tactile feedback for the player, to guide finger placement. In some embodiments, the string indicators I-IV are illuminated as described below. Illuminated string indicators I-IV do not alter the tactile surface of the fingerboard 100. Illuminated string indicators I-IV may be programmed to have variable widths according to the pitch of the string being represented. For example, on a stringed instrument, low strings that produce pitches at the low end of the range of the instrument e.g., the violin G string (IV), are generally of a thicker gauge, while high strings that produce pitches at the high end of the range of the instrument (e.g., the violin E string, I) are of a thinner gauge. In some embodiments, the number of string indicators may be less or greater than four, for example the string indicators may be numbered I-V so that, for example, the instrument 80 can combine the range of the violin and the viola, similar to a five-stringed electric instrument.

FIG. 2B is a side view of an exemplary portion 116 of the fingerboard 100, e.g., a portion between the $6^{th}$ and the $10^{th}$ pitch indicators. FIG. 2B illustrates a top surface 118 of the fingerboard 100 that may include a plurality of layers. In some embodiments, the string indicators I-IV extend above the top surface 118 of the fingerboard 100, thus providing a raised, textured surface and tactile feedback for the player. One or more layers of the top surface 118 may be made of a hard, pliable material, while other layers of the top surface 118 may provide a soft, resilient, and/or pressure-sensitive fingering pad so as to detect finger placement. An exemplary flexible electronic pressure-sensitive fingering pad is the Morph™, available from Sensel, Inc. of Mountain View, Calif. Pressure sensors in the top surface 118 may interpret changes in finger pressure to create harmonic sounds consistent with the way in which string harmonics are created by varying finger pressure on strings of a conventional instrument.

FIG. 2C is a view of the proximal end 104 of the fingerboard 100 showing curvature of the fingerboard 100 and the conformal top surface 118. A degree of lateral curvature along the width of the fingerboard 100 is defined by an angle 110 with respect to a normal 112. A height 114 of the fingerboard 100 above the top 83 of the instrument 80 is also indicated. A flexible top surface 118 will conform to the lateral curvature of the fingerboard 100.

Figure 3A:
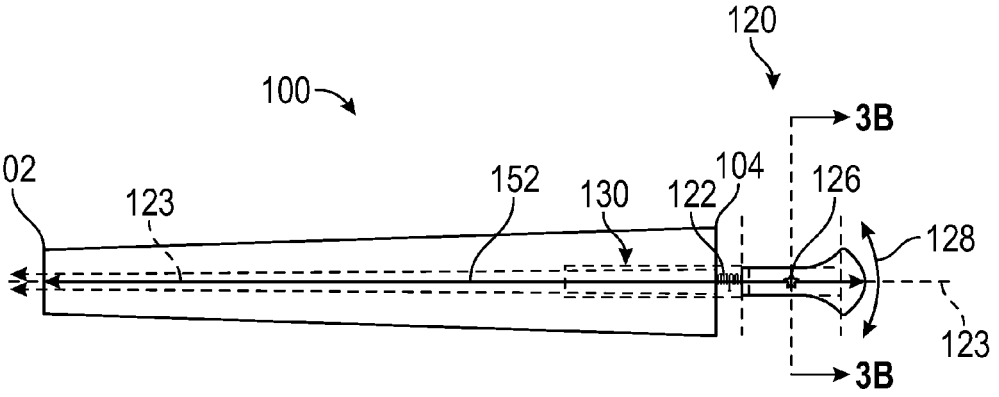
FIGS. 3A-3D are top plan, cross-sectional, side elevation, and end views, respectively, of an instrument fingerboard supporting an adjustable bowing platform, according to some embodiments of the present disclosure as described herein.

FIGS. 3A-3D show different views of the fingerboard 100 equipped with the vibrational bowing platform 120, according to some embodiments of the present disclosure. The vibrational bowing platform receives the bow 124 on a bowing surface 126. The bow 124 includes a stick 132 and bow hair 134, as is known in the art. In some embodiments, positions of the vibrational bowing platform are adjustable. As shown in FIG. 3A, the vibrational bowing platform 120 is spaced apart from the fingerboard 100 by a variable distance 122. The variable distance 122 may be adjusted by sliding, e.g., extending or retracting, the vibrational bowing platform 120 relative to the proximal end 104, along an axis 123 aligned with a length of the fingerboard 100. The vibrational bowing platform 120 also has an angular adjustment 128, e.g., clockwise or counterclockwise, relative to the axis 123. Settings of the variable distance 122 and the angular adjustment 128 may be locked in place by a locking device 129.

Figure 3B:
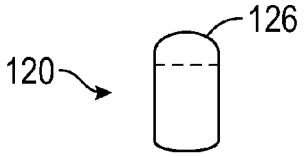

FIG. 3B shows a cross-sectional view of the bowing platform 120 and the bowing surface 126. The vibrational bowing platform 120 supports or includes one or more tracks having e.g., convex features or edges that vibrate in response to drawing the bow hair 134 across a contact surface 126 located on the axis 123. Tracks may be made of metal, for example. Vibrations of the contact surface 126 of each track correspond to the lengths of the notes. Such vibrations will also vary depending on pressure applied to the bow 124, tilt of the bow 124, which changes the contact area between the bow hair 134 and the contact surface 126, bow speed, bow angle, and the like. Variations in the vibration of the bowing platform 120 can be sensed by piezoelectric sensors in the bowing platform 120, for use in creating nuances in an electronically-generated musical sound.

Figure 3C:
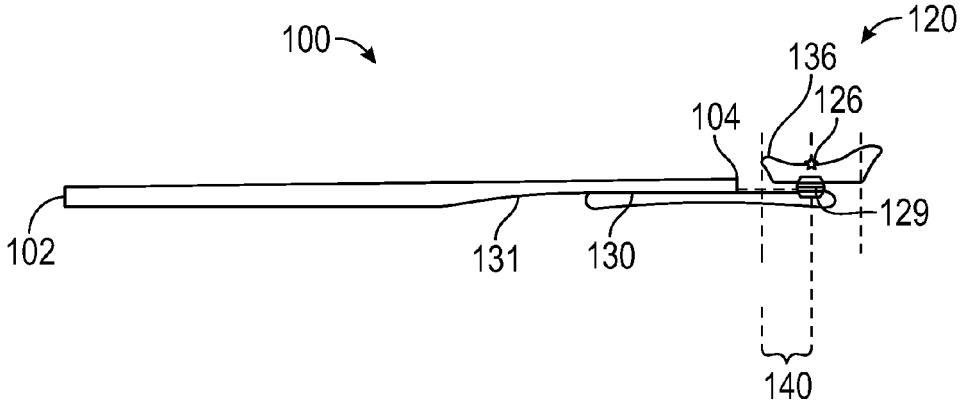

In some embodiments, the bowing platform 120 is mounted to the fingerboard 100 by a mounting bracket 130, as shown in FIG. 3C. The mounting bracket 130 may be attached, optionally using hardware, to an underside 131 of the fingerboard 100. The underside 131 of the fingerboard 100 may be longitudinally curved so as to hide the mounting bracket 130. Alternatively, the mounting bracket 130 may be installed within the fingerboard 100 so that the mounting bracket 130 slides out from the proximal end 104. A top surface of the mounting bracket 130 may be etched with distance markings for use in measuring the variable distance 122. Alternatively, the bowing platform 120 may mount directly to the proximal end 104 of the fingerboard 100 without a mounting bracket.

Figure 3D:
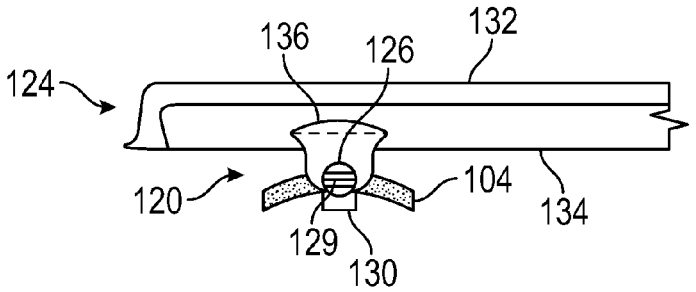
Figure 4A:
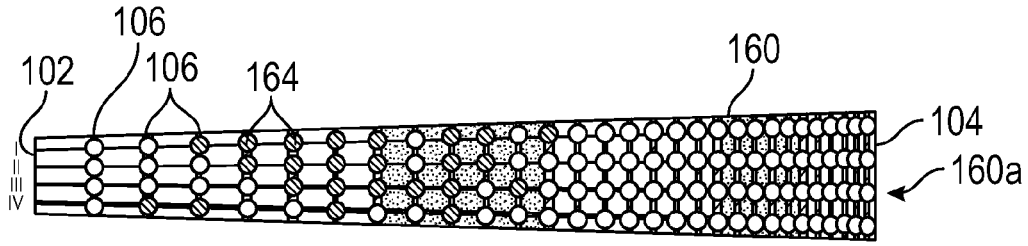
FIGS. 4A-4D are top plan views of an instrument fingerboard that incorporates an interactive digital touchscreen display according to some embodiments of the present disclosure as described herein.
Figure 4B:
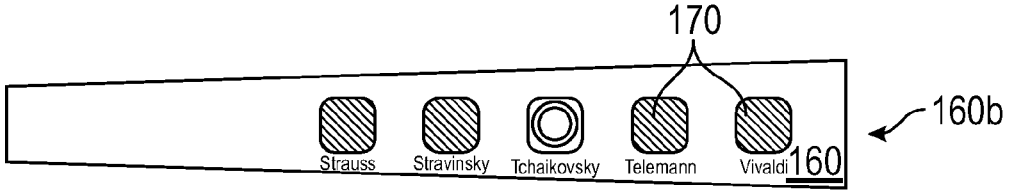
Figure 4C:
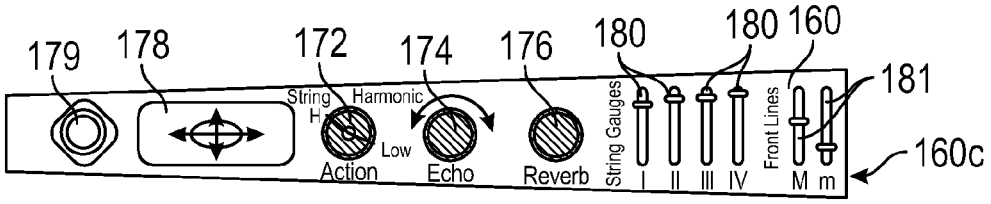
Figure 4D:
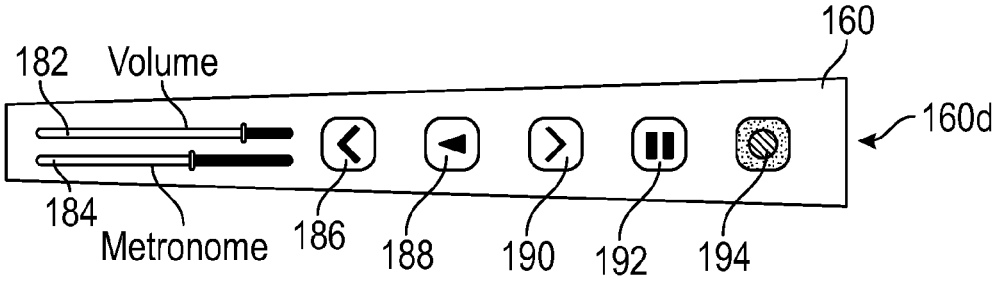

In some embodiments, the bowing platform 120 may have a concave profile 136, similar to a saddle, so that the bow 124 is guided toward the bowing surface 126 located at a lowest position of the concave profile 136, as in the side view shown in FIG. 3C and the end view shown in FIG. 3D. In some embodiments, the bowing platform 120 may have a flatter profile, e.g., for a more advanced player, or for use in a Baroque-style instrument set-up.

FIGS. 4A-4D illustrate a fingerboard 100 equipped with a touch screen display 160 having different operational modes 160*a*-160*d*, according to some embodiments of the present disclosure. The touch screen display 160, e.g., a capacitive touch-sensitive layer covering a display screen, functions as a graphical user interface (GUI) that displays information and accepts user inputs, as is generally known in the art of electronic devices. As implemented on the fingerboard 100, the touch screen display 160 provides integrated electronic pitch sensors that cover the entire area of the fingerboard 100. In some embodiments, the touch screen display 160 is flexible so as to conform to the lateral curvature of the fingerboard 100. In a default exercise mode 160*a*, pitch indicators 106, string indicators I-IV, and target finger positions 164 are illuminated along the pitch indicators 106 on the touch screen display 160 while the touch screen display 160 senses finger placement to create note pitches.

The touch screen display 160 may operate in many different operational modes in which additional functions can be selected and accessed. In some embodiments, voice commands may be used to quickly switch between modes or to more easily access different functions. Such operational modes may include, for example, a performance mode, a control panel mode, a recording mode, a playback mode, a play-along mode, a game mode, and a silent mode. For example, in a play along mode 160*b* shown in FIG. 4B, buttons 170 are displayed that allow a user to select from a digital library, e.g., a web-based or cloud-based library, or a library stored in a local digital memory, works by various composers to play along with. In the play along mode 160*b*, the display may revert to the default mode 160*a*, illuminating certain ones of the target pitch locations 164 that correspond to demonstration music being played back from the digital library. In a tone mode 160*c* shown in FIG. 4C, various buttons are displayed for user selection. For example, an action button 172 adjusts a response of the fingerboard 100 to finger pressure, and may provide a pressure threshold setting that distinguishes harmonic sounds from sounds consistent with those of a stopped string; a button 174 provides an echo effect; and a button 176 provides reverb. Other settings may be configured to control tone quality such as attack, and dynamic range. Target pitch location settings 178 provide adjustments to customize diameters or shapes, e.g., circles, ellipses, of illuminated target pitch locations 164 in the default mode 160*a*. Thus, beginners can set the sizes of target pitch locations 164 to be larger than those for use by advanced players. A lock button 179 locks in the target pitch location settings 178. Likewise, slide bars 180, 181 are used to adjust widths of the illuminated graphics for pitch indicators 106 and string indicators I-IV that are displayed when in the default mode 160*a*. In a playback mode 160*d* shown in FIG. 4D, a first slide bar 182 adjusts volume and a second slide bar 184 adjusts a metronome beat frequency. Conventional recording and playback buttons are also provided, such as back 186, play 188, forward 190, stop 192, and record 194. The interactive fingerboard 100 may be programmed so that holding down the back button 186 or the forward button 90 may slow down or speed up playback of a recording. Recordings can be saved in a digital memory for later retrieval, or for combination with recording tracks saved by other musicians. In a performance mode, the touch screen display 160 may appear blank, or may display only the string indicators I-IV like a conventional fingerboard, while the fingerboard 100 continues to sense finger positions. Other settings may provide color or background pattern choices for the display itself.

Figure 5A:
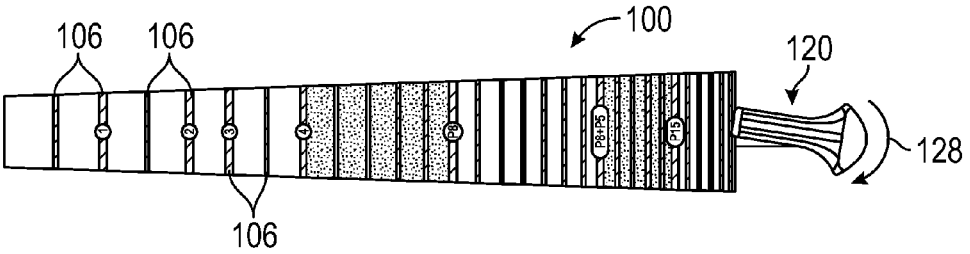
FIGS. 5A-5E are top plan views of the touch-sensitive instrument fingerboard of FIG. 4A on which virtual strings, fret lines, and finger positions are illuminated according to selectable patterns.
Figure 5B:
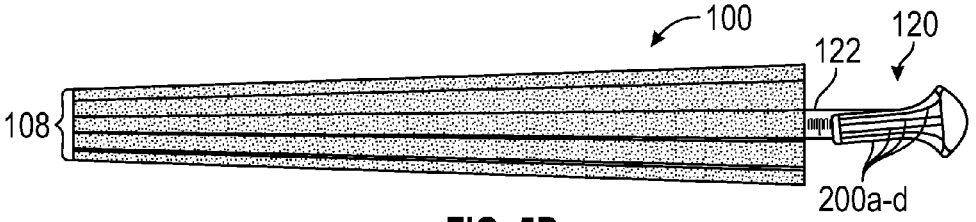
Figure 5C:
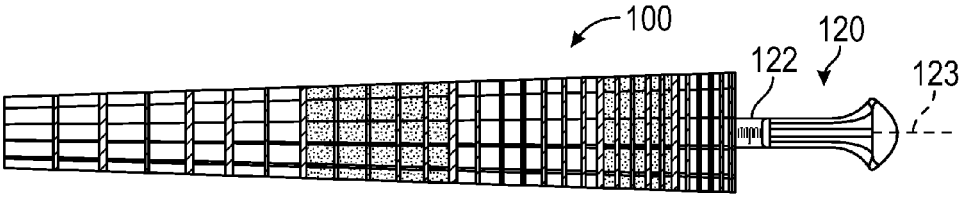
Figure 5D:
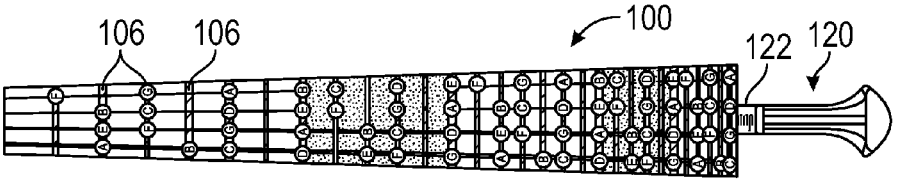
Figure 5E:
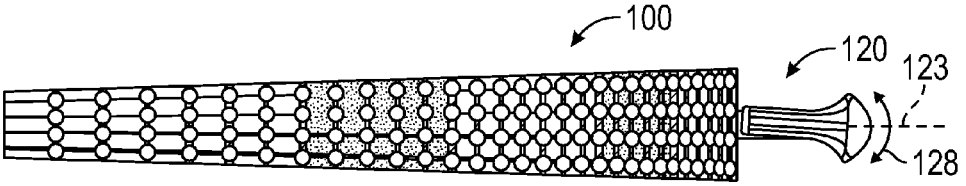

FIGS. 5A-5E illustrate various selectable illumination patterns for the touch screen display 160 operating in the default mode 160*a*. For example, if a beginning player wishes assistance in placing fingers at the correct pitch locations for playing a scale, a fret line illumination pattern that includes finger numbering such as the one shown in FIG. 5A can be selected. Alternatively, only the strings I-IV may be illuminated as shown in FIG. 5B, which resembles a fingerboard of a conventional instrument. In FIG. 5C, both the pitch indicators 106 and the string indicators I-IV are illuminated. In FIG. 5D, finger positions and corresponding note names, e.g., the letters A-G, or phonemes, are illuminated. The note names and finger numbering may also be displayed larger, e.g., by ballooning, when they are illuminated. In FIG. 5E, finger positions are shown without the note names and can illuminate combinations of notes, for example, notes in a particular chord or scale.

FIGS. 5A-5E also show different positions for an adjustable bowing platform 120. For example, FIGS. 5C and 5D show the adjustable bowing platform 120 aligned with the fingerboard axis 123, while FIGS. 5A, 5B, and 5E show the adjustable bowing platform 120 rotated slightly with respect to the fingerboard axis 123. FIGS. 5A and 5E show the adjustable bowing platform 120 in a non-extended (retracted) sliding position, while in FIG. 5D, the adjustable bowing platform 120 is partially extended and in FIGS. 5B and 5C, the adjustable bowing platform 120 is fully extended.

Figure 6A:
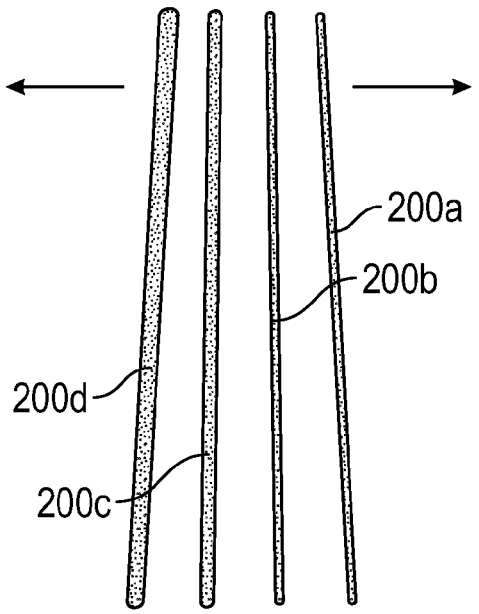
FIGS. 6A-6B are top plan views of an adjustable multi-track bowing platform shown in expanded and contracted configurations, respectively, according to some embodiments of the present disclosure as described herein.
Figure 6B:
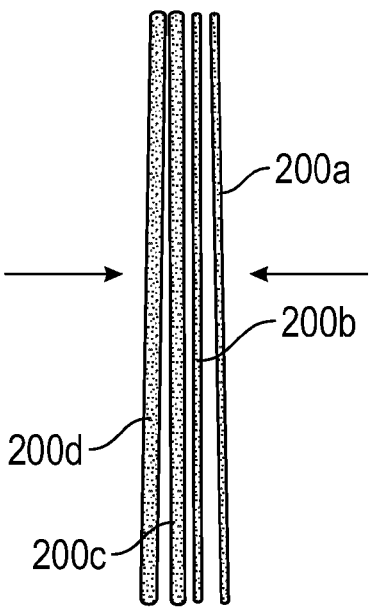

FIGS. 5A-5E and 6A-6B illustrate a further adjustment of the bowing platform 120, which is shown as having multiple bowing surfaces, or tracks 200*a*-200*d*. FIGS. 6A, 6B show adjustments of the width of the bowing platform 120 causing the multiple tracks 200*a*-200*d* to become farther apart (FIG. 6A), or closer together (FIG. 6B), ultimately forming a uni-track bowing surface 126. Adjustments can be made by squeezing the tracks 200*a*-200*d* together or pulling them apart. The adjustable vibrational bowing platform 120 may further include sensor strips along the tracks 200*a*-200*d* that sense changes in radial position of the bow 124.

Figure 7:
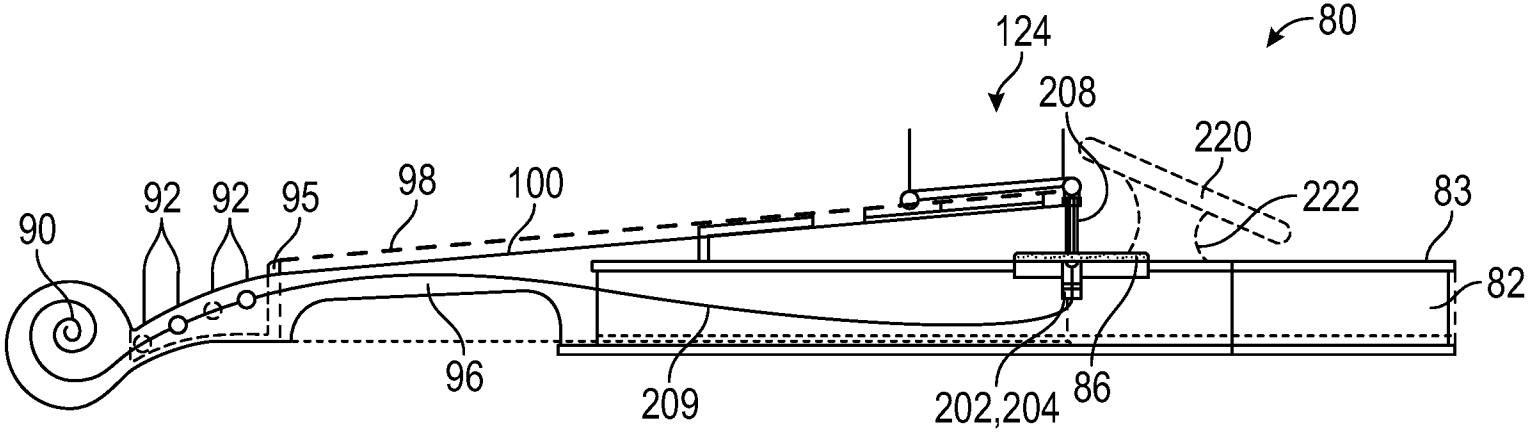
FIG. 7 is a side elevation view of the advanced stringless bowed instrument shown in FIG. 1, equipped with optical pitch sensors and a mobile device interface, according to some 8 embodiments of the present disclosure as described herein.
Figure 8:
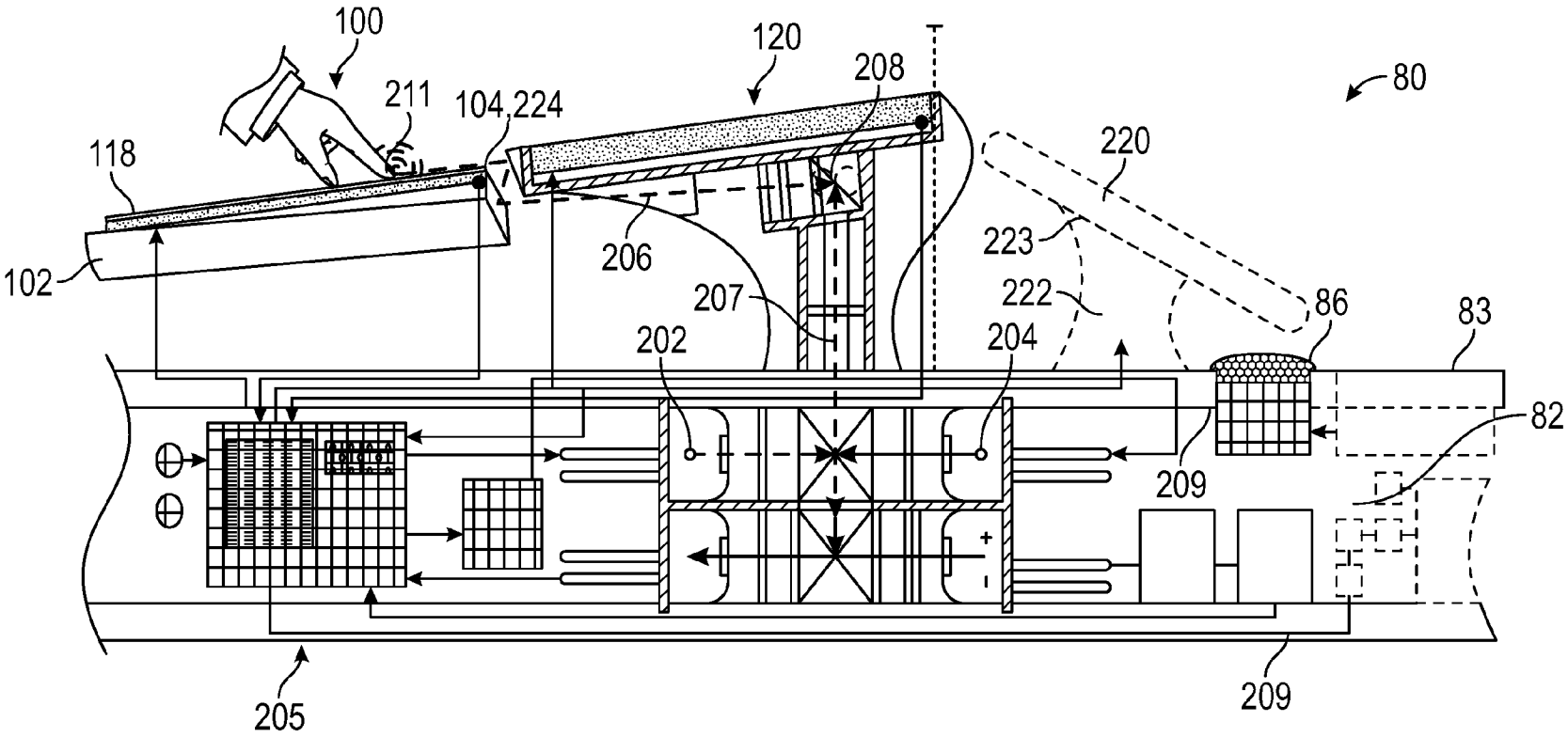
FIG. 8 is a block diagram of a feedback control system suitable for use with the instrument shown in FIG. 7, according to some embodiments of the present disclosure as described herein.

FIG. 7 and FIG. 8 show side views of the stringless bowed instrument 80 equipped with optical pitch sensors that sense finger positions via a light beam. According to some embodiments of the present disclosure, the stringless bowed instrument 80 includes one or more laser sources 202, e.g., visible laser or infrared laser sources, and one or more optical pitch sensors 204 that detect finger positions on the fingerboard 100. The laser sources 202 may include rechargeable power supplies, or may be coupled to a rechargeable power supply. In some embodiments, e.g., FIG. 7, the laser source 202 may be part of a fiber laser apparatus in which one or more fiber laser sources 207, located for example near the scroll 90, are pumped so as to generate a light beam 209. A pump 92 may be accommodated adjacent to the scroll 90, in place of pegs that would be present in a conventional instrument. The light beam 209 is amplified while propagating within an optical fiber that extends along a length, e.g., through the neck 96 and through the body 82 of the bowed instrument 80 to the location of the laser source 202. The light beam 209 emerges, following amplification, as a laser beam 206. In some embodiments, e.g., FIG. 8, the laser source 202 is a solid state laser source that generates a laser beam 206, e.g, a low-power He—Ne red laser beam of the type suitable for use in bar code scanning devices. In some embodiments, the laser beam 206 may be a highly tunable laser beam of arbitrary wavelength. The laser beam 206 is directed upward through a waveguide 207 in the support for the bowing platform 120, toward a mirror 208. The mirror 208 re-directs propagation of the laser beam 206 along the fingerboard 100, producing a luminous virtual string 98. In some embodiments, the laser beam 206 is directed along a path from underneath the bowing platform 120 toward the fingerboard 100. A first mirror 224 at the proximal end 104 and a second mirror 226 on an opposing end of the bowing platform 120 reflect the laser beam 206, causing the laser beam 206 to propagate slightly above the surface 118 of the fingerboard 100. In some embodiments, the laser source 202 is a visible laser source. In some embodiments, an infrared laser source is also provided either in the body 82 or mounted on the bowing platform 120. The laser beam 206 may combine laser light from both the visible and infrared portions of the spectrum.

Figure 9A:
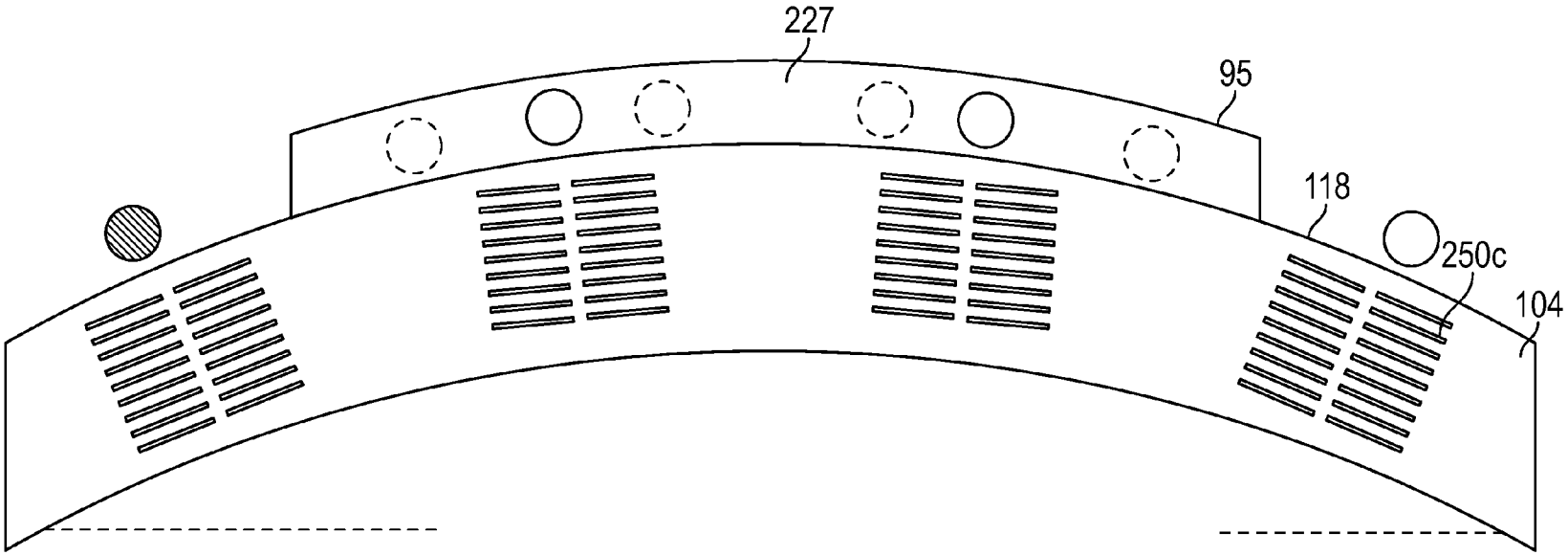
FIG. 9A is an end view of a light scattering surface at the distal end of the fingerboard shown in FIG. 7.

FIG. 9A shows a magnified end view of the nut 95, located at the distal end 102 of the fingerboard 100. A third mirror 227 attached to a front surface of the nut 95 reflects the laser beam 206, causing the laser beam 206 to propagate back toward the optical pitch detector 204.

Figure 9B:
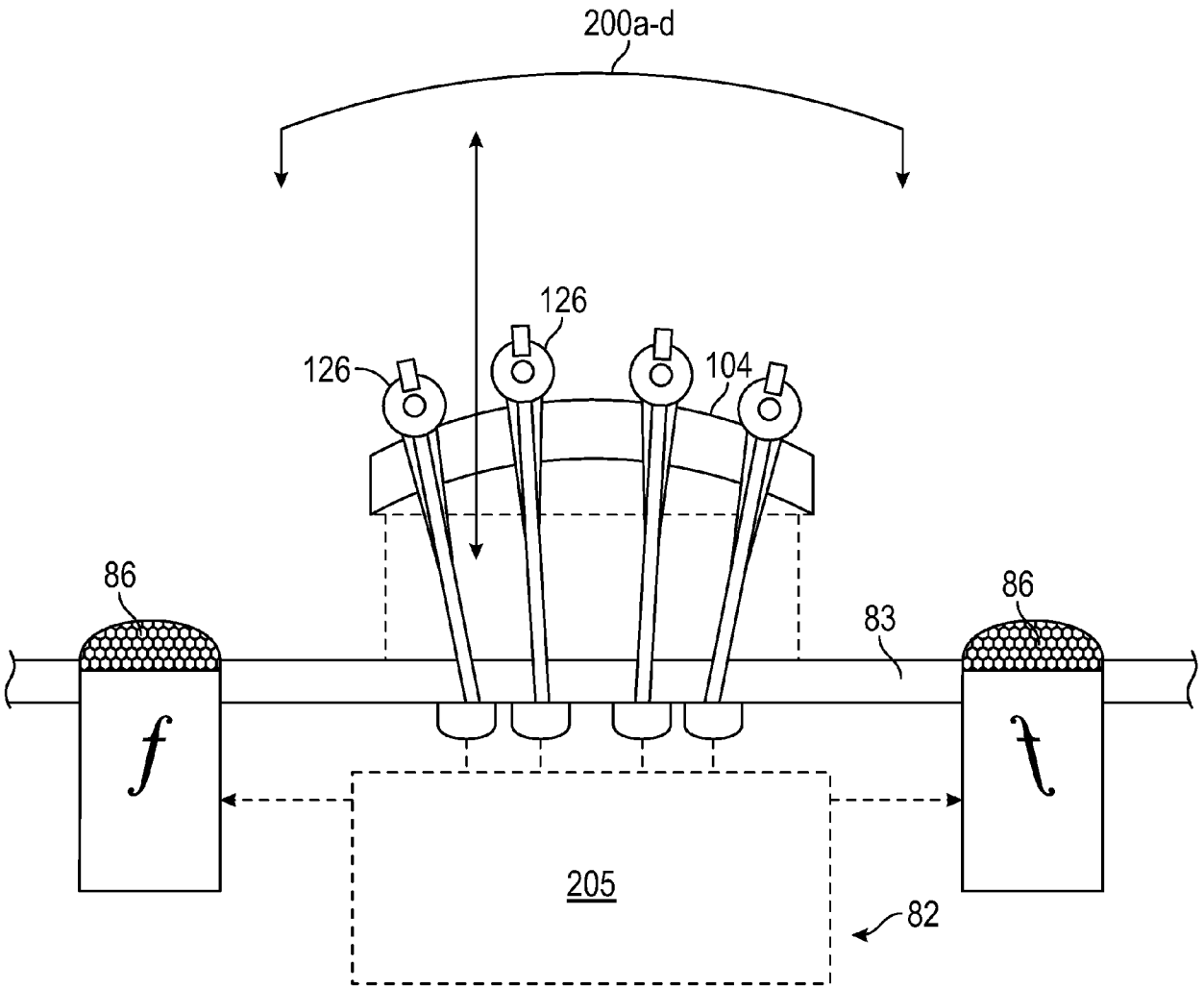
FIG. 9B is an end view of a fingerboard equipped with light sources and receivers, according to some embodiments of the present disclosure as described herein.

FIG. 9B shows a magnified cross-sectional view of the proximal end 104 of the fingerboard 100 and an adjustable multi-track bowing platform 120 having four radial tracks, 200*a*-200*d*. Orientation of the radial tracks 2100*a-d* follows the curvature of the fingerboard 100 consistent with FIGS. 6A-6B. FIG. 9B further illustrates signal processing circuitry 205 within the body 82. The multi-track bowing platform 120 is secured underneath the top 83 of the instrument 80. Each of the tracks 200*a*-200*d* provides a separate bowing surface 126.

Figure 10A:
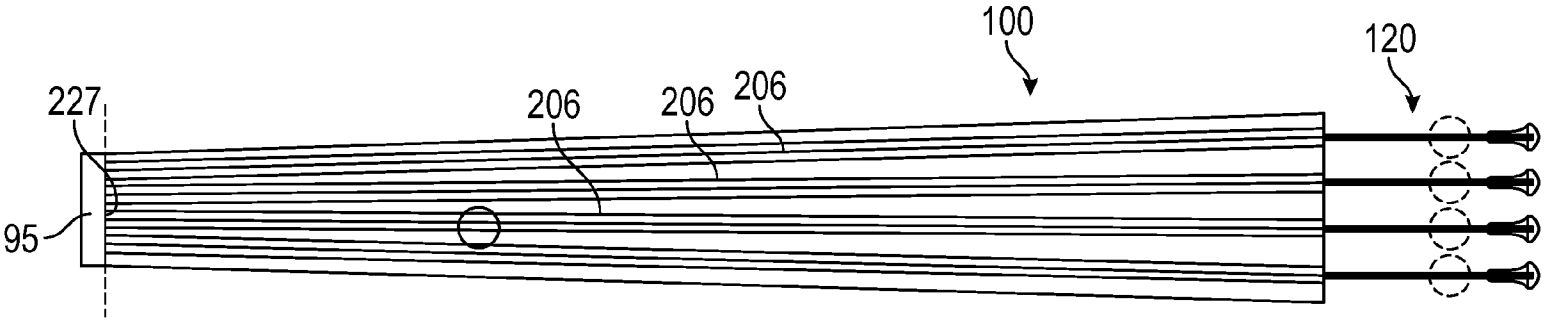
FIGS. 10A and 10B are top plan and side elevation views, respectively, of the stringless instrument shown in FIG. 1, equipped with a laser source and optical pitch sensors, according to some embodiments of the present disclosure as described herein.

In some embodiments, a beam splitter and/or a prism can be inserted in the path of the laser beam 206 to produce a plurality of different colored laser beams 206 corresponding to a plurality of luminous virtual strings 98 as shown in FIG. 10A. When a finger is placed on the fingerboard 100 at the finger location 211, thereby intercepting propagation of one or more of the laser beams 206, a change in path length of the intercepted laser beam(s) 206 is sensed by the one or more optical pitch sensors 204. From the change in path length, the finger position 211 can be determined and a corresponding can be computed from the sensed finger placement. In some embodiments, the optical pitch sensors 204 are provided to supplement finger position information acquired by a touch-sensitive fingerboard 100 and associated signal processing circuitry 205. The signal processing circuitry 205 may include one or more power supplies, e.g., one or more rechargeable batteries. In some embodiments, e.g., without a touch-sensitive fingerboard, the optical pitch sensors 204 detect the finger positions.

Signals detected by the optical pitch sensors 204 and/or the touch-sensitive fingerboard 100 and associated circuitry 205 are processed to produce one or more output signals 209. Signal processing may occur in a controller 210 or other microprocessor located, e.g., in the body 82 to produce sound via the speakers 86. In some embodiments, the speakers 86 protrude through the top 83. Additionally or alternatively, sound may be produced by directing the output signal 209 to an external amplifier as is known in the art of electric instruments. By processing bow sensor signals together with finger position data, a determination can be made as to the temporal lengths of notes and whether a virtual string 98 is being bowed as an open string, a fingered string, or is not being played with the bow 124. When finger positions are sensed on the fingerboard, while the bow sensors do not sense signals, the controller 210 can be programmed to produce a pizzicato sound.

Additionally or alternatively, signal processing may occur in a mobile device 220 mounted to the body 82 by a mount, e.g., a pedestal 222 having a socket 223. The mobile device 220 may be, e.g., a smart phone that runs an application ("app") for the stringless bowed instrument, or the mobile device 220 may be a device dedicated to the stringless bowed instrument 80. Signals may be communicated between the mobile device 220 and the optical pitch sensors 204 via wired communication paths that pass through the pedestal 222. Additionally or alternatively, signals may be communicated between the mobile device 220 and the optical pitch sensors 204 via a wireless communication link that includes a transmitter communicatively coupled to the optical pitch sensor 204. The mobile device 220 may also be programmed with one or more applications that operate various features of the stringless bowed instrument 80. Such features may include operation of the interactive touch sensitive fingerboard 160 having modes 160*a-d* as shown in FIGS. 4A-4D and described above.

Figure 10B:
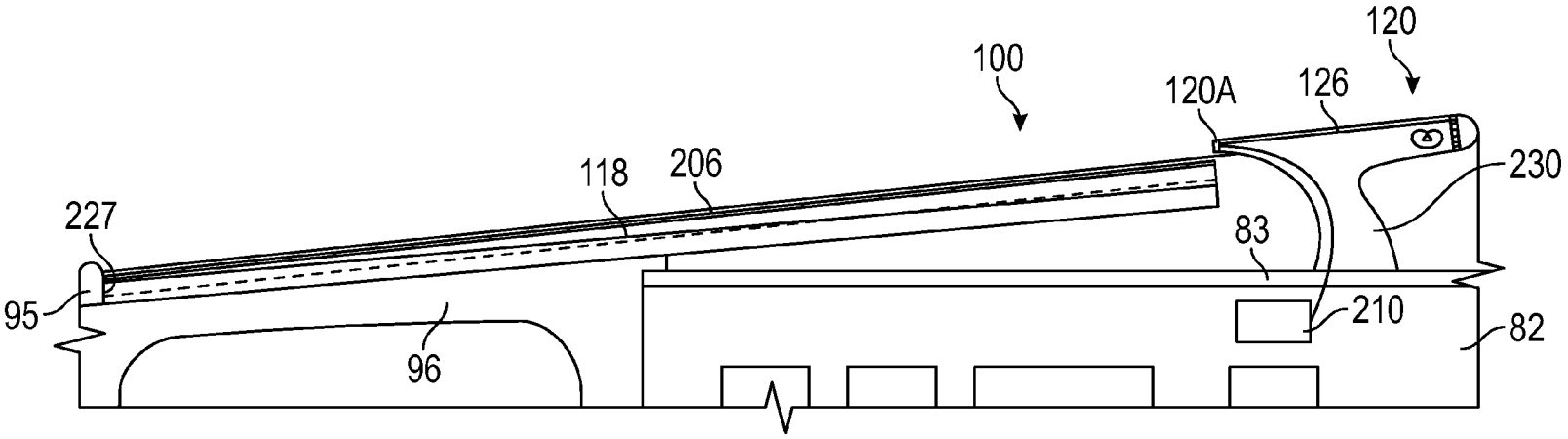
Figure 11:
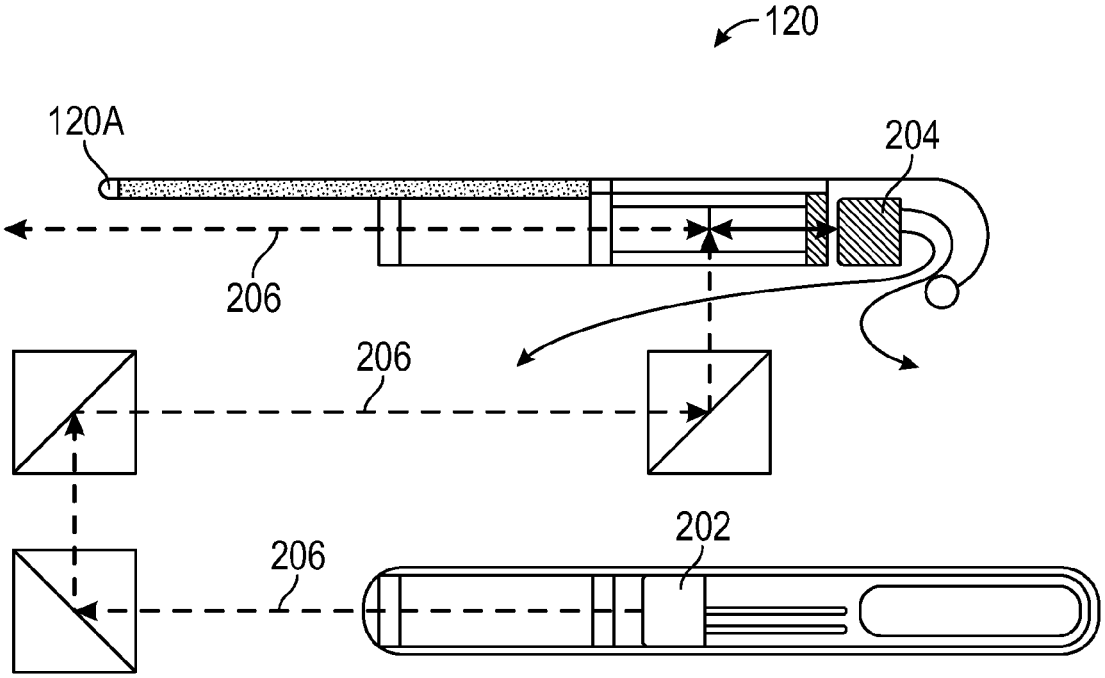
FIG. 11 is a schematic of a laser beam source and detector apparatus integrated with a bowing track, according to some embodiments of the present disclosure as described herein.

In some embodiments, the laser source 202 is a solid state type laser source as shown in FIGS. 10B and 11. The laser source 202 and the optical pitch detector 204 are located in the bowing platform 120, e.g., so that the laser beam 206 emerges from a leading edge of the bowing platform 120*a* as shown in FIG. 10B, or from underneath the bowing platform 120 as shown in FIG. 11. The bowing platform 120 may be mounted to the top 83 of the body 82 by a support 230, instead of being mounted to the fingerboard 100. Such a design may provide a shorter and less complicated path for the laser beam 206, compared with a laser source located in the body 82. Sensed signals may be communicated from the optical pitch sensor 204 to the controller 210 via a wireless communication path, or via a wired communication path that passes through the support 230.

Figure 12A:
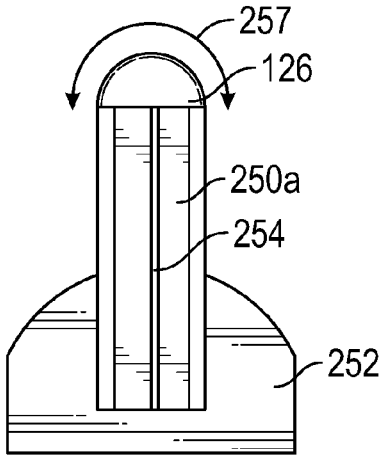
FIG. 12A is an end view of a flexible element of a bow sensor, according to some embodiments of the present disclosure as described herein.
Figure 12B:
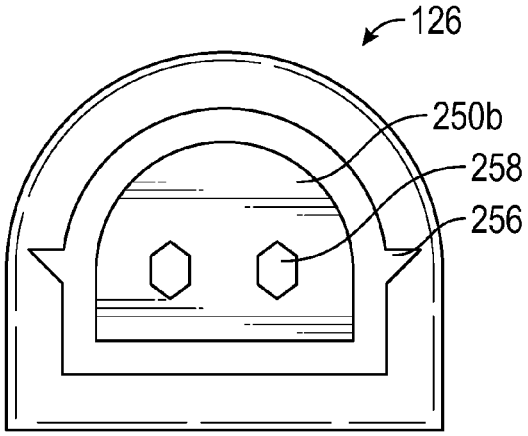
FIG. 12B is an end view of a bowing surface, according to some embodiments of the present disclosure as described herein.
Figure 12C:
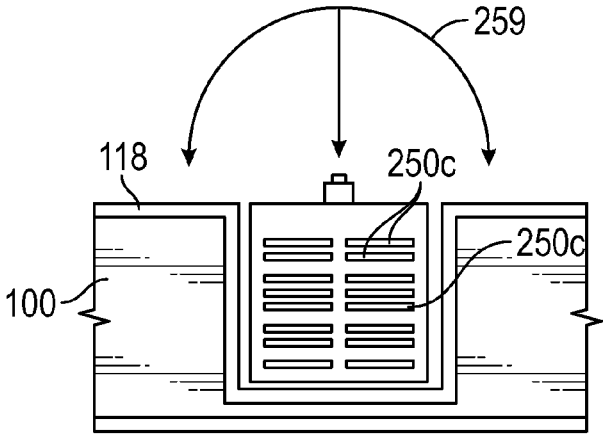
FIG. 12C is an end view of a pressure sensor integrated with a fingerboard, according to some embodiments of the present disclosure as described herein.

FIGS. 12A, 12B, and 12C show detailed views of piezo-ceramic sensor elements 250, according to some embodiments of the present disclosure. Each implementation of a piezo-ceramic sensor element 250 senses vibrations and converts energy in the form of vibrations or pressure into electric current. In FIG. 12A, a piezo-ceramic element 250*a* is integrated with a vibrational bowing surface 126 that is set in motion by drawing the bow 124 in a semi-circular arc 251 over the vibrational bowing surface 126. The piezo-ceramic element 250*a* is attached to a base 252 supporting a flexible blade 254. Such flexible blades 254 are aligned with radial axes so as to extend in a direction substantially perpendicular to the arched surface of the fingerboard 100. In FIG. 12B, a piezo-ceramic sensor element 250*b* is configured for use within, or underneath, the bowing surface 126. An internal flexible metal surface 256 transmits vibrations from the bowing surface 126 to the piezo-ceramic element 250*b* so that the vibrations can be sensed. Electric leads may be coupled to the piezo-ceramic element 250*b* by insertion into openings 258. The piezo-ceramic element 250*b* may be incorporated into the mounting bracket 130, the locking device 129, or directly into the bowing platform 120. In FIG. 12C, a stacked piezo-ceramic element 250*c* integrated with the fingerboard 100 is configured to sense a downward component of finger pressure 259 on the surface 118 of the fingerboard 100. Stacked piezo-ceramic elements 250*c* are also shown integrated with the fingerboard 100 in FIG. 9A. Electrical wiring for use in transmitting sensor signals may be routed within or underneath the fingerboard 100, within the support 230, or within the body 82. In some embodiments, the piezo-ceramic sensors 250*a-c* may be equipped with wireless transmitters to send wireless signals to the controller 210.

Figure 13:
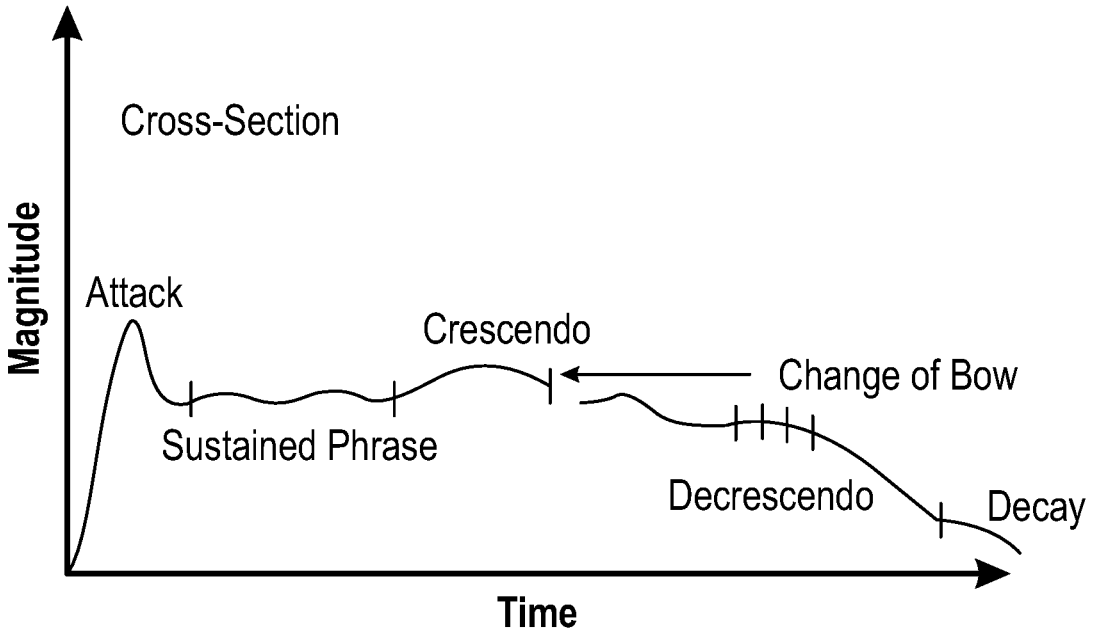
FIG. 13 is a plot of sound output from a bow sensor and an optical pitch sensor, according to some embodiments of the present disclosure as described herein.

FIG. 13 illustrates one example of the output signal 209, derived from sensed finger position signals, e.g., from the optical pitch detectors 204, and sensed bow movements, e.g., from bow sensor signals that sense movement of the bow on the bowing surface 126. The output signal 209 may be amplified to create an audible sound. The output signal 209 is a time-varying signal that exhibits variations in magnitude that will translate to variations in sound intensity upon amplification. The variations in magnitude of the output signal 209 may include, for example, an attack at the beginning of the output signal 209, a sustained phrase, dynamic changes such as crescendo/decrescendo, and a decay in magnitude. Changes in direction of the bow being drawn across the bowing surface 126 may be sensed as breaks in the output signal 209 or as periodic changes in intensity.

The foregoing description, for purpose of explanation, has been made with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A musical instrument, comprising:

a body;

a neck attached to the body;

a fingerboard attached to the neck, the fingerboard including a touch sensitive layer configured to detect finger positions and finger pressure;

a bowing platform in contact with either the fingerboard or the body, the bowing platform having an adjustable bowing surface for placement of a bow, the bowing platform including bow sensors configured to detect vibrations of the bowing surface in response to motion and pressure of the bow; and a microprocessor programmed to generate an output signal based on the detected finger positions and finger pressure and the detected vibrations of the bowing surface, wherein the output signal corresponds to a sound.

2. The musical instrument of claim 1, wherein the touch sensitive layer comprises a touch sensitive display, further comprising:

a power supply;

electronic components configured to drive the touch sensitive display; and a computer-readable memory, the memory storing instructions that cause the microprocessor to output selected illumination patterns on the touch sensitive display.

3. The musical instrument of claim 2, wherein the touch sensitive display is interactive and the instructions implement a plurality of selectable operational modes of the interactive touch sensitive display.

4. The musical instrument of claim 3 wherein the operational modes include one or more of a performance mode, a control panel mode, a recording mode, a playback mode, a play along mode, an exercise mode, a game mode, and a silent mode.

5. The musical instrument of claim 3, wherein the plurality of operational modes is selectable based on user input from a mobile device.

6. The musical instrument of claim 4 wherein one or more of the operational modes is programmed to cause different illumination patterns to be displayed on the interactive touch sensitive display based on a user selection.

7. The musical instrument of claim 4 wherein one or more of the operational modes is programmed to cause vibration of the fingerboard in response to touch data sensed by finger position sensors of the fingerboard, the touch data including a touch location and a touch pressure.

8. The musical instrument of claim 1 wherein the touch sensitive layer is flexible and conforms to the shape of a bowed instrument fingerboard.

9. The musical instrument of claim 1 wherein the fingerboard includes one or more layers of fiberglass, metal, glass, ceramic, crystalline, rubber, acrylic, or polymer materials.

10. The musical instrument of claim 1, wherein the fingerboard comprises pressure sensors configured to detect the finger pressure.

11. The musical instrument of claim 1, wherein the microprocessor is programmed to transmit the output signal to speakers or an amplifier to generate the sound.

12. The musical instrument of claim 1, wherein the microprocessor is programmed to transmit the output signal to a mobile device configured to process the output signal.

13. The musical instrument of claim 1, wherein the touch sensitive layer is configured to set a pressure threshold based on user input, and wherein the microprocessor is programmed to generate the output signal based on the pressure threshold.

14. A method, comprising:

displaying an illumination pattern on a touch screen fingerboard of a stringless musical instrument;

electronically sensing finger placement and finger pressure on the touch screen fingerboard;

electronically sensing vibrations of one or more bowing surfaces of a bowing platform of the stringless musical instrument in response to motion and pressure of a bow contacting the bowing platform; and generating an output signal based on the sensed finger placement, the sensed finger pressure, and the sensed vibrations of the one or more bowing surface, wherein the output signal corresponds to a sound.

15. The method of claim 14, wherein the bowing platform is mounted to the fingerboard.

16. The method of claim 14, wherein the bowing platform includes a plurality of retractable tracks having adjustable spacing between tracks to control a number of the one or more bowing surfaces configured to receive the bow, further comprising:

detecting a radial position of the bow based on sensor strips along the tracks of the plurality of tracks.

17. The method of claim 14 wherein the bowing platform has a concave profile.

18. The method of claim 14, wherein the electronically sensing of the vibrations comprises using a piezo-ceramic device of the bowing platform, further comprising:

electronically sensing a change in the finger pressure on the fingerboard using a piezo-ceramic device integrated with the fingerboard, wherein the output signal is generated based on the change.

* * * * *